United States Patent [19]

Shihabi

[11] Patent Number: 4,719,003

[45] Date of Patent: Jan. 12, 1988

[54] PROCESS FOR RESTORING ACTIVITY OF DEWAXING CATALYSTS

[75] Inventor: David S. Shihabi, Pennington, N.J.

[73] Assignee: Mobil Oil Corporation, New York, N.Y.

[21] Appl. No.: 853,384

[22] Filed: Apr. 16, 1986

Related U.S. Application Data

[63] Continuation of Ser. No. 621,981, Jun. 18, 1984, abandoned.

[51] Int. Cl.[4] ..... C10G 67/06

[52] U.S. Cl. ..... 208/91; 502/21; 502/38

[58] Field of Search ..... 208/91, 254 R; 502/38, 502/21

[56] References Cited

U.S. PATENT DOCUMENTS

| | | | |
|---|---|---|---|
| 3,055,825 | 9/1962 | Buningh et al. | 208/254 R |
| 4,028,223 | 6/1977 | Hayes et al. | 208/91 |
| 4,282,085 | 8/1981 | O'Rear et al. | 208/120 |
| 4,313,821 | 2/1982 | Garwood et al. | 208/245 |
| 4,357,232 | 11/1982 | Holland | 208/87 |
| 4,358,362 | 11/1982 | Smith et al. | 208/91 |
| 4,372,839 | 2/1983 | Oleck et al. | 208/59 |

*Primary Examiner*—Olik Chaudhuri

*Attorney, Agent, or Firm*—Alexander J. McKillop; Michael G. Gilman; Marina V. Schneller

[57] ABSTRACT

It has been discovered that although a spent dewaxing catalyst based on a shape selective zeolite catalyst can be regenerated to restore its alpha activity, while substantially maintaining the acid site density of the fresh catalyst, the aging rate of that regenerated catalyst applied in multi-cycle dewaxing operations increases from cycle to cycle. In accordance with the invention use of a sorbent guard bed upstream of the dewaxing catalyst bed and regeneration of the dewaxing catalyst, isolated from the sorbent guard bed with recycle of such regenerated dewaxing catalyst, to the multi-cycle dewaxing operation is described. The result is that the increase in aging rate, referred to above is substantially eliminated, which provides predicatability of conditions in second, third and fourth dewaxing cycles.

20 Claims, 3 Drawing Figures

PROCESS FOR RESTORING ACTIVITY OF DEWAXING CATALYSTS

This is a continuation of copending application Ser. No. 621,981, filed on June 18, 1984, now abandoned.

BACKGROUND OF THE INVENTION

1. Field of the Invention

This invention relates to improvements in processes for the catalytic hydrodewaxing of hydrocarbon chargestocks. More specifically, the present invention is concerned with restoring the activity of spent hydrodewaxing catalysts to fresh activity.

2. Description of the Prior Art

The cracking and/or hydrocracking of petroleum stocks is, in general, well known and widely practiced. It is known to use various zeolites to catalyze cracking and/or hydrocracking processes. The cracking may have the intent to convert a certain class of compounds in order to modify a characteristic of the whole petroleum stock. Exemplary or this type of conversion is shape selective conversion of straight and slightly branched aliphatic compounds of 12 or more carbon atoms to reduce pour point, viscosity, and/or to improve pumpability of heavy fractions which contain these waxy constituents. The long carbon chain compounds tend to crystallize on cooling of the oil to an extent such that the oil will not flow, hence, may not be able to be pumped, transported by pipelines, or useful for effective lubrication. The temperature at which such mixture will not flow is designated as the "pour point," as determined by standardized test procedures.

The pour point problem can be overcome by techniques known in the art for removal of waxes or conversion of these compounds to other hydrocarbons which do not crystallize at ambient temperatures. An important method for so converting waxy hydrocarbons is shape selective cracking or hydrocracking utilizing principles described in U.S. Pat. No. 3,140,322, dated July 7, 1964. Zeolite catalysts for selective conversions of wax described in the literature include such species as mordenite, with or without added metal to function as a hydrogenation catalyst.

Particularly effective catalysts for catalytic dewaxing include zeolite ZSM-5 and related porous crystalline aluminosilicate zeolites as described in U.S. Pat. No. Re. 28,398 (Chen et al), dated Apr. 22, 1975. As described in that patent, drastic reductions in pour point are achieved by catalytic shape selective conversion of the wax content of heavy stocks with hydrogen in the presence of a dual-function catalyst of a metal plus the hydrogen form of ZSM-5. The conversion of waxes is by scission of carbon-to-carbon bonds (cracking) and production of products of lower boiling point than the wax. However, only minor conversion occurs in dewaxing. For example, Chen et al describes hydrodewaxing of a full range shale oil having a pour point of +80° F. to yield a pumpable product of pour point at −15° F. The shift of materials from the fraction heavier than light fuel oil to lighter components was in the neighborhood of 9 percent conversion.

Catalytic hydrodewaxing of middle distillates and higher boiling lubricating oil stocks has been successfully developed to a stage of commercial operation. The process effectively dewaxes most of the distillate feeds available. However, individual chargestocks, of similar boiling point, may vary as far as the difficulty in catalytically dewaxing the respective chargestocks. This difficulty is manifested in the need for higher initial reaction temperatures for dewaxing, as much as 50° F. It is speculated that much of the difference in reaction temperature is due to differences in the content of compounds which are poisonous to the dewaxing catalyst and contained in the chargestock. In particular, differences in nitrogen-containing compounds are suspected of being the primary reason certain chargestocks require higher reaction temperatures.

It is known to remove poisonous nitrogen-containing compounds from waxy feedstocks prior to catalytic dewaxing. Thus, it is known to pass the feed to be dewaxed initially through a bed of hydrotreating catalyst and thereafter through a bed of the hydrodewaxing catalyst. Such a process is described in U.S. Pat. No. 4,257,872, dated Mar. 24, 1981. The hydrotreating catalysts typically employed are metals or metal oxides of Group VIB and/or Group VIII deposited on a solid porous support such as silica and/or metal oxides such as alumina, titanium, zirconia, or mixtures thereof. Representatives of Group VIB metals include molybdenum, chromium and tungsten and Group VIII metals include nickel, cobalt, palladium and platinum. The metal components are deposited, in the form of metals or metal oxides, on the indicated supports in amounts generally between about 0.1 and about 20 wt.%. Initial hydrotreating of the feed serves to convert sulfur, nitrogen, and oxygen derivatives of the hydrocarbon feed to hydrogen sulfide, ammonia and water.

It is also known to increase the effectiveness of a dewaxing catalyst such that the dewaxing catalyst behaves as if it were catalytically more active or more resistant to aging by pretreating the hydrocarbon feed with a zeolite molecular sieve maintained under sorption conditions. It was postulated that the feed contains minute amounts of catalytically deleterious impurities which were sorbed by the catalyst and served as catalyst poisons. Although the precise nature or composition of the catalyst poisons was not known, it was speculated that basic nitrogen compounds, and oxygen and sulfur compounds, may be involved. The substitution of a clay or other sorbent for the zeolite was also suggested as producing some increased activity, but of much lesser magnitude, than is achieved by the zeolite sorbent, although clay was thought to remove a greater fraction of the nitrogen compounds. Sorption conditions included a temperature ranging from 35°–350° F. Patents disclosing such a process include U.S. Pat. Nos. 4,357,232; 4,358,362; and 4,358,363, all assigned to Mobil Oil Corporation.

It has been found, however, that even upon removal of nitrogen compounds from the waxy hydrocarbon stock by solvent stripping or by use of ion exchange resins prior to catalytic dewaxing, the dewaxing catalyst ages in the same manner and, in fact, ages faster than catalysts dewaxing an untreated feed. Thus, it appears that the observed catalyst aging is more complex than any straight forward relationship to nitrogen content. Such is also shown in above-mentioned U.S. Pat. Nos. 4,357,232; 4,358,362; and 4,358,363 where, upon pretreating the feed to remove nitrogen compounds, catalyst behavior is not necessarily altered in a manner consistent with the removal of nitrogen compounds.

It has now been found that even after successive air regenerations of a dewaxing catalyst, catalyst deactivation is irreversible and that the aging rate of the catalyst increases over the fresh catalyst and further increases after each successive air regeneration.

Accordingly, it is an object of the present invention to restore the catalytic activity of an aged dewaxing catalyst to fresh activity, even after multiple regeneration of the aged catalyst.

SUMMARY OF THE INVENTION

It has now been found that the activity of a zeolite molecular sieve dewaxing catalyst can be restored to fresh activity for dewaxing a lubricating oil stock when the feed, prior to dewaxing, is contacted at elevated temperatures with an absorbent. Typical absorbents which are useful as the guard bed of the present invention include alumina, clay, bauxite, spent catalysts, and the like.

It is believed that ash and other heavy components from the hydrocarbon feed tend to build up within the zeolite crystallite or the pore mouth during dewaxing. Thus, even after oxidative regeneration to remove or burn off coke particles from the active sites of the catalysts, these materials interact with the zeolite and modify its surface. What results is a gradual decline in activity such that increases in temperature are required during dewaxing to achieve the activity of the fresh catalyst. Pretreating the feed with the guard bed absorbent traps the ash and other heavy components from the hydrocarbon charge without affecting original catalyst activity in the absence of the absorbent.

Thus, this invention is different from previous patents which sought to increase the resistance to aging of a fresh catalyst or increase the activity thereof so as to reduce the inventory of dewaxing catalyst or, reduce the operating temperature or increase the space velocity of the feed. In fact, it has been shown that the activity of a fresh catalyst and a spent catalyst which has been regenerated in air are substantially equivalent based on the alpha scale and that the acid site densities of the respective catalysts are essentially the same. However, without contacting the feed with the guard bed, the regenerated catalyst shows an increased aging rate compared to the fresh catalyst even though the acid activities are the same. It is believed, therefore, that the guard bed catalyst removes heavy components from the feed which appear to build up within the pores of the zeolite and interact with the zeolite upon removal by oxidative regeneration. The result of this interaction is the novel observation of catalyst dewaxing activity decline in the absence of any measurable acid activity loss.

Moreover, consistent with what has been stated in the prior patents as mentioned above, the removal of nitrogen compounds selectively from the feed, does not necessarily result in an improvement in the catalyst aging rate and longer on-stream time between catalyst regenerations.

SPECIFIC EMBODIMENTS

Figure 1:
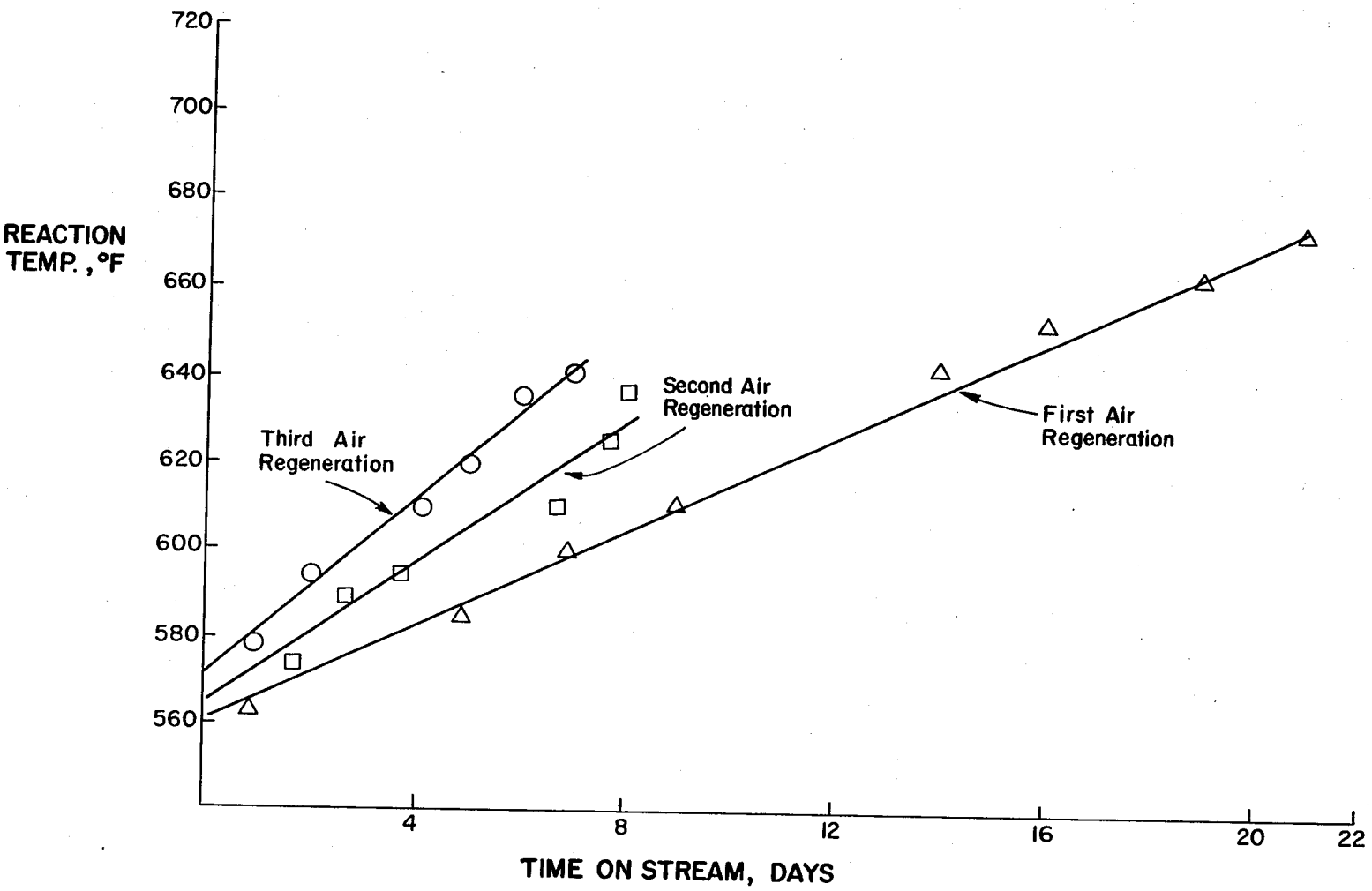
FIG. 1 is a plot illustrating the aging curves of regenerated catalysts without use of guard bed.

The feed to be dewaxed by the process of this invention may be any waxy hydrocarbon oil that has a pour point which is undesirably high. Petroleum distillates such as atmospheric tower gas oils, kerosenes, jet fuels, vacuum gas oils, whole crudes, reduced crudes, and propane deashalted residual oils are contemplated as suitable feeds. Also contemplated are oils derived from tar sands, shale, and coal. A particular embodiment of this invention is applicable to lube oil stocks in which the process of the present invention is used to prepare low pour point lube oil stocks with superior oxidation resistance.

Lubricating oils are, for the most part, based on petroleum fractions boiling above about 450° F. The molecular weight of the hydrocarbon constituents is high and these constituents display almost all conceivable structures and structure types. This complexity and its consequences are referred to in "Petroleum Refinery Engineering," by W. L. Nelson, McGraw Hill Book Company, Inc., New York, N.Y., 1958 (4th Ed.), relevant portions of this text being incorporated herein by reference for background.

In general, the basic notion in lubricant refining is that a suitable crude oil, as shown by experience or by assay, contains a quantity of lubricant stock having a predetermined set of properties, such as, for example, appropriate viscosity, oxidation stability, and maintenance of fluidity at low temperatures. The process of refining to isolate that lubricant stock consists of a set of subtractive unit operations which removes the unwanted components. The most important of these unit operations include distillation, solvent refining, and dewaxing, which essentially are physical separation processes in the sense if all the separated fractions were combined, one would constitute the crude oil.

It is interesting to note that catalytic dewaxing, unlike prior art dewaxing processes, although subtractive, is not a physical process but rather depends upon transforming the straight chain and other waxy paraffins to non-wax materials. The process however, is more economical and thus of industrial interest, even though at least some loss of salable wax is inherent. Commercial interest in catalytic dewaxing is evidence of the need for more efficient refinery processes to produce low pour lubricants.

The first step of the process of this invention requires that the feed be treated by contact with a sorbent under sorption conditions effective to remove at least some of the deleterious impurity. These conditions may cover a fairly wide range of time, temperature and pressure, and may be conducted in the presence of hydrogen. The conditions, both broad and preferred, for this step of the process are indicated in Table 1.

The catalytically deleterious impurities, or poisons, will be referred to herein as "contaminants" regardless of whether these occur naturally associated with the feed or are acquired by the feed from some known or unknown source during transportation, processing, etc.

TABLE 1

| | Sorption Conditions | |
|---|---|---|
| | Broad | Preferred |
| Temperature, °F. | >350 | 400–800 |
| Pressure, psig | 0–3000 | 25–1500 |
| LHSV, $hr^{-1}$ | 0.1–100 | 0.2–20 |

In general, although it is preferred to conduct the pretreating step in a flow system, wherein the sorbent particles are in the form of a fixed bed of 1/16 inch or less to ¼ inch extrudate or pellets, other modes of contact may be employed such as slurrying the feed oil with a finely powdered sorbent followed by centrifugation and recycle of the sorbent. The precise conditions selected for the sorption step will be determined by various considerations, including the nature of the feed and the desired degree of refinement, the latter being judged from the observed catalytic consequences of the treatment.

For purposes of this invention, the sorbents used as the guard bed include alumina, clay, bauxite, spent catalysts, etc. A sorbent having a surface area of at least 50 $m^2/g$ and at least 10% of the pores being in the range of 30–100 Å is useful in this invention. Gamma-alumina, eta-alumina, or mixtures thereof are effective sorbents. Additionally, the sorbent may consist of molecular sieve type zeolites with or without exchange capacities having pores with an effective diameter of at least about 5 Angstroms. Another class of sorbents that could be used also include a family of crystalline microporous aluminophosphates (U.S. Pat. No. 4,385,994) and silicoaluminophosphate (U.S. Pat. No. 4,440,871). These sorbents can be used alone or in combination with other refractory inorganic oxides.

Illustrative of zeolites with pores of 5 Angstroms are zeolite A in the calcium salt form, chabazite and erionite, which sorb normal paraffins but exclude all other molecules of larger critical diameter. Other zeolites which may be used which have larger pore diameters include zeolite X, zeolite Y, offretite and mordenite. The last group of zeolites sorbs molecules having critical diameters up to about 13 Angstroms, and all of them sorb cyclohexane freely.

In addition to the zeolites already enumerated, any of the zeolites described more fully hereinbelow which are useful as dewaxing catalysts also may be used as sorbents. In fact, the zeolite utilized as sorbent and as dewaxing catalyst may have the same crystal structure. Since the dewaxing catalyst will be more fully described hereinbelow, it is unnecessary at this point to repeat the description.

In general, the pretreated feed is separated from the sorbent and passed to the catalytic dewaxing step where its pour point is reduced, usually by selective conversion of the high molecular weight waxes to more volatile hydrocarbon fragments.

Various embodiments of the present invention are contemplated. In one of these, the feed is contacted with a dewaxing catalyst under sorption conditions after which a pretreated feed is recovered and passed to storage. The material used as sorbent is now treated, for example, with steam at elevated temperature, to remove the sorbed deleterious impurity, and the stored treated hydrocarbon is passed over the regenerated sorbent now maintained at dewaxing conditions. In general, however, it is more effective to employ at least one separate bed of molecular sieve zeolite as sorbent.

The step of catalytically dewaxing the pretreated feed is illustrated for different hydrocarbon oils in U.S. Pat. No. Re. 28,398 and in U.S. Pat. Nos. 3,956,102 and 4,137,148, for example. The entire content of these patents is herein incorporated by reference.

The dewaxing step may be conducted with or without hydrogen, although use of hydrogen is preferred. It is contemplated to conduct the dewaxing step at the dewaxing conditions shown in Table II.

TABLE II

| | Dewaxing Step | |
|---|---|---|
| | Broad | Preferred |
| | Without Hydrogen | |
| Temperature, °F. | 400–100 | 500–800 |
| LHSV, $hr^{-1}$ | 0.3–20 | 0.5–10 |
| Pressure, psig | 0–3000 | 25–1500 |
| | With Hydrogen | |
| Temperature, °F. | 400–1000 | 500–800 |
| LHSV, $hr^{-1}$ | 0.1–10 | 0.5–4.0 |
| $H_2$/HC mol ratio | 1–20 | 2–10 |
| Pressure, psig | 0–3000 | 200–1500 |

Useful dewaxing catalysts include crystalline aluminosilicate zeolites having a constraint index within the range of 1–12.

The novel class of zeolites defined herein is exemplified by ZSM-5, ZSM-11, ZSM-12, ZSM-23, ZSM-35, ZSM-38, ZSM-48, and other similar materials.

ZSM-5 is described in greater detail in U.S. Pat. Nos. 3,702,886 and Re. 29,948. The entire descriptions contained within those patents, particularly the X-ray diffraction pattern of therein disclosed ZSM-5, are incorporated herein by reference.

ZSM-11 is described in U.S. Pat. No. 3,709,979. That description, and in particular the X-ray diffraction pattern of said ZSM-11, is incorporated herein by reference.

ZSM-12 is described in U.S. Pat. No. 3,832,449. That description, and in particular the X-ray diffraction pattern disclosed therein, is incorporated herein by reference.

ZSM-23 is described in U.S. Pat. No. 4,076,842. The entire contents thereof, particularly the specification of the X-ray diffraction pattern of the disclosed zeolite, are incorporated herein by reference.

ZSM-35 is described in U.S. Pat. No. 4,016,245. The description of that zeolite, and particularly the X-ray diffraction pattern thereof, is incorporated herein by reference ZSM-38 is more particularly described in U.S. Pat. No. 4,046,859. The description of that zeolite, and particularly the specified X-ray diffraction pattern thereof, is incorporated herein by reference.

ZSM-48 is more particularly described in U.S. Pat. No. 4,397,827. The description of that zeolite, and particularly the specified X-ray diffraction pattern thereof, is incorporated herein by reference.

When synthesized in the alkali metal form, the zeolite is conveniently converted to the hydrogen form, generally by intermediate formation of the ammonium form as a result of ammonium ion exchange and calcination of the ammonium form to yield the hydrogen form. In addition to the hydrogen form, other forms of the zeolite wherein the original alkali metal has been reduced to less than about 1.5 percent by weight may be used. Thus, the original alkali metal of the zeolite may be replaced by ion exchange with other suitable metal cations of Groups I through VIII of the Periodic Table, including, by way of example, nickel, copper, zinc, palladium, calcium or rare earth metals.

In practicing the invention, it may be useful to incorporate the above-described crystalline zeolite with a matrix comprising another material resistant to the temperature and other conditions employed in the process.

Useful matrix materials include both synthetic and naturally occurring substances, as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-beryllia, and silica-titania, as well as ternary compositions, such as silica-alumina-thoria. Silica-alumina-zirconia, silica-alumina-magnesia and silica-magnesia-zirconia. The matrix may be in the form of a cogel. The relative proportions of zeolite component and inorganic oxide gel matrix, on an anhydrous basis, may vary widely with the zeolite content ranging from between about 1 to about 99 percent by weight and more usually in the range of about 5 to about 80 percent by weight of the dry composite.

Certain aspects of the present invention will now be illustrated by reference to examples which are not to be construed as limiting the scope of this invention, which scope is determined by this entire specification including the claims thereof.

EXAMPLE 1

Bright stock raffinate having the properties set forth in Table 3 was dewaxed (1 LHSV, 400 psig, 2500 scf $H_2$/B) over a dewaxing catalyst comprising 65% ZSM-5/35% alumina. Properties of the dewaxing catalyst are shown in Table 4. The catalyst was used for seven processing cycles with hydrogen reactivation in between the first four cycles (120 days) and oxygen regeneration for all subsequent cycles. In all cases air regeneration was carried out in situ in a stream containing less than 1% $O_2$ during initial coke burn off. Final coke burn off was accomplished by a stream containing 50% air at 950° F.

The experiments were carried out in stainless steel micro-units. The reactor was ⅝" ID with ⅛" axial thermowell containing 15 cc (8.6 grams) of the as received extrudate catalyst diluted with 15 ccc 14/20 vycor mesh.

TABLE 3

| Bright Stock Properties | |
|---|---|
| Specific gravity | 0.90 |
| Viscosity | |
| KV @ 100° C. | 29.71 |
| KV @ 300° F. | 9.31 |
| Aniline point | 251 |
| Elemental analysis, wt. % | |
| Carbon | 85.53 |
| Hydrogen | 13.16 |
| Sulfur | 1.31 |
| Nitrogen (ppm) | 130 |
| Basic Ni (ppm) | 100 |
| Ash, wt. % | −.01 to 0.02 |
| Furfural (ppm) | 8.0 |
| Oil Content, wt. % | 80.62 |
| Refractive index (70° C.) | 1.4872 |
| COR, wt. % | .7 |
| Paraffins | 18 |
| Naphthenes | 34 |

TABLE 3-continued

| Bright Stock Properties | |
|---|---|
| Aromatics | 48 |
| Distillation: | |
| Wt. % | °F. |
| IBP | 800 |
| 5 | 912 |
| 10 | 944 |
| 20 | 980 |
| 30 | 998 |
| 40 | 1014 |
| 50 | 1030 |
| 55 | 1045 |
| 80 | 1100 |

TABLE 4

| Catalyst Properties | |
|---|---|
| Alpha activity | 101 |
| Crystallinity | 55 |
| Density, g/cc | |
| Real | 2.49 |
| Particle | .80 |
| Packed | 0.58 |
| Surface area, $m^2/g$ | 350 |
| Pore volume, cc/g | .714 |
| Average pore diameter, A | 82 |
| PV percent in pore of: | |
| 0–100 A | 51 |
| 100–150 | 13 |
| 140–200 | 6 |
| 200–300 | 5 |
| 300+ | 25 |
| Crush strength, 16/inch | 70 |
| Ni, wt. % | 1.1 |
| Na, wt. % | 0.02 |

The aging curves in FIG. 1 summarize the results of this study. Aging rates of 5°/day, 8.5°/day, and 10° F./day following first, second and third air regenerations were obtained. In addition, start of cycle temperature increased 5°–10° F. following every air regeneration. Upon completion of the dewaxing run following the third air regenerations, the catalyst was air regenerated and submitted for alpha and acid sites density measurements. The alpha values were evaluated after $H_2S$ of the fresh and spent catalysts. The reported alpha values were 120 and 140 for fresh and spent catalysts, respectively. Acid site densities of the fresh catalyst and the air regenerated spent catalyst are essentially the same at 0.202 and 0.221 MEQ N/g CAT, respectively.

EXAMPLE 2

Bright stock of Example 1 was dewaxed in a micro-unit similar to the one used in Example 1. The reactor had a ⅝" ID and contained 15 cc of the as received extrudate catalyst mixed with 10 cc 80/100 mesh sand. In this example, the axial thermocouple was removed to maximize feed distribution throughout the catalyst bed. The catalyst was used for seven processing cycles with hydrogen reactivation in between the first four cycles and air regeneration for all subsequent cycles.

Figure 2:
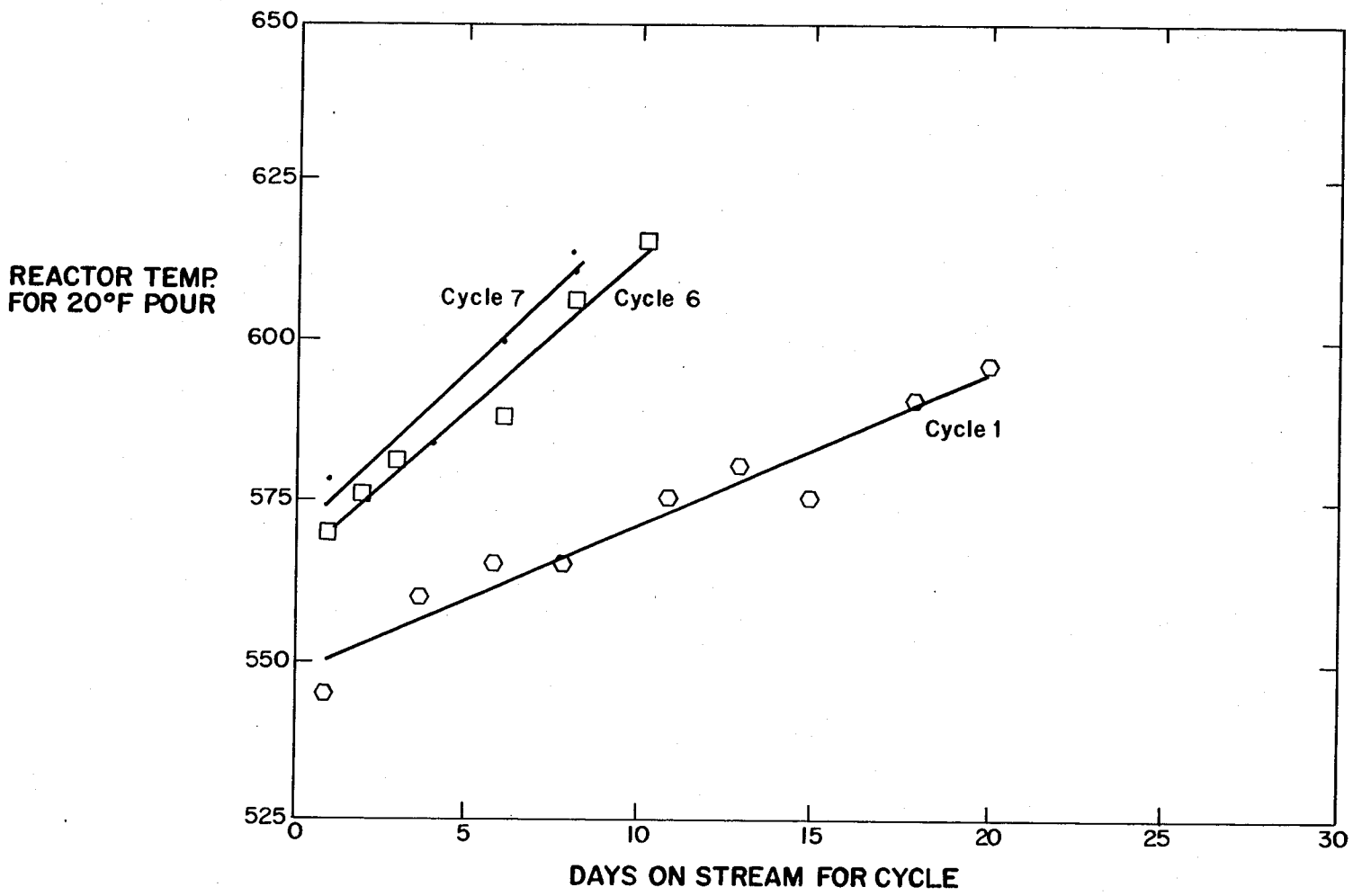
FIG. 2 is a plot illustrating the aging curves of regenerated and fresh catalysts without use of guard bed.

The aging curves for fresh and air regenerated catalyst are shown in FIG. 2. Aging rate increased from 2.3/day for fresh catalyst to 4.1° F./day and 5.5° F./day for first and second air regeneration.

To partially answer the question of possible catalyst deactivation as a result of air regeneration or steam dealuminiation, alpha value and acid site density of the spent and fresh catalysts were measured. Upon completion of the last cycle (7th cycle), the catalyst was air regenerated in a procedure similar to that used for the second air regeneration and submitted for analysis. Alpha values were evaluated after $H_2S$ treatment of the fresh and spent catalysts. The reported alpha values were 125 and 115 for fresh and spent catalysts, respectively. Acid site densities of the fresh catalyst and the air regenerated spent catalyst are essentially the same at 0.23 and 0.24 MEQ N/g CAT, respectively.

Based on these results, the data is consistent with build-up of "materials" within the crystallite or the pore mouth or catalyst surface modification, as proposed.

EXAMPLE 3

The experiments were carried out in stainless steel type-two-stage reactor systems. The first reactor (⅝" I.D.) contained 30 cc of American Cynamid Alumina (surface area ~200m²/g) mixed with 20 cc 20/60 mesh sand. The second reactor (⅝" I.D. contained 15 cc of the as-received 101 α dewaxing catalyst of Example 1 mixed with 15 cc 20/60 mesh sand. The experiments consisted of seven processing cycles with air regeneration in between the first four cycles. Standard hydrogen activation before the fifth cycle and air regeneration before the last two cycles. Hydrogen activation was done at 900° F. for 24 hours at 305 psig in once-through hydrogen circulation (2500 SCF/B based on 1 LHSV). Fresh alumina guard bed was used with each new cycle (alumina was dried by purging with hydrogen −300° F.).

Fresh and air regenerated catalysts were presulfided prior to catalytic evaluation. The guard bed, which was changed at the end of each cycle, was bypassed during high temperature purging, oxygen regeneration and presulfiding. Bypassing the guard bed during high temperature purging was carried out to prevent guard bed desorbed materials to pass over the dewaxing catalyst. Hydrogen and feed were passed over the alumina guard bed at 0.5 LHSV, 550° F. and 400 psig, and the product was cascaded over the dewaxing catalyst. Dewaxing conditions over the catalyst were 0.9 LHSV, 400 psig and 2500 SCF $H_2$/B. The guard bed temperature was held constant at 550° F., while the dewaxing reactor temperature was increased so as to maintain 10°-20° F. pour points on the 750° F.+ product.

Figure 3:
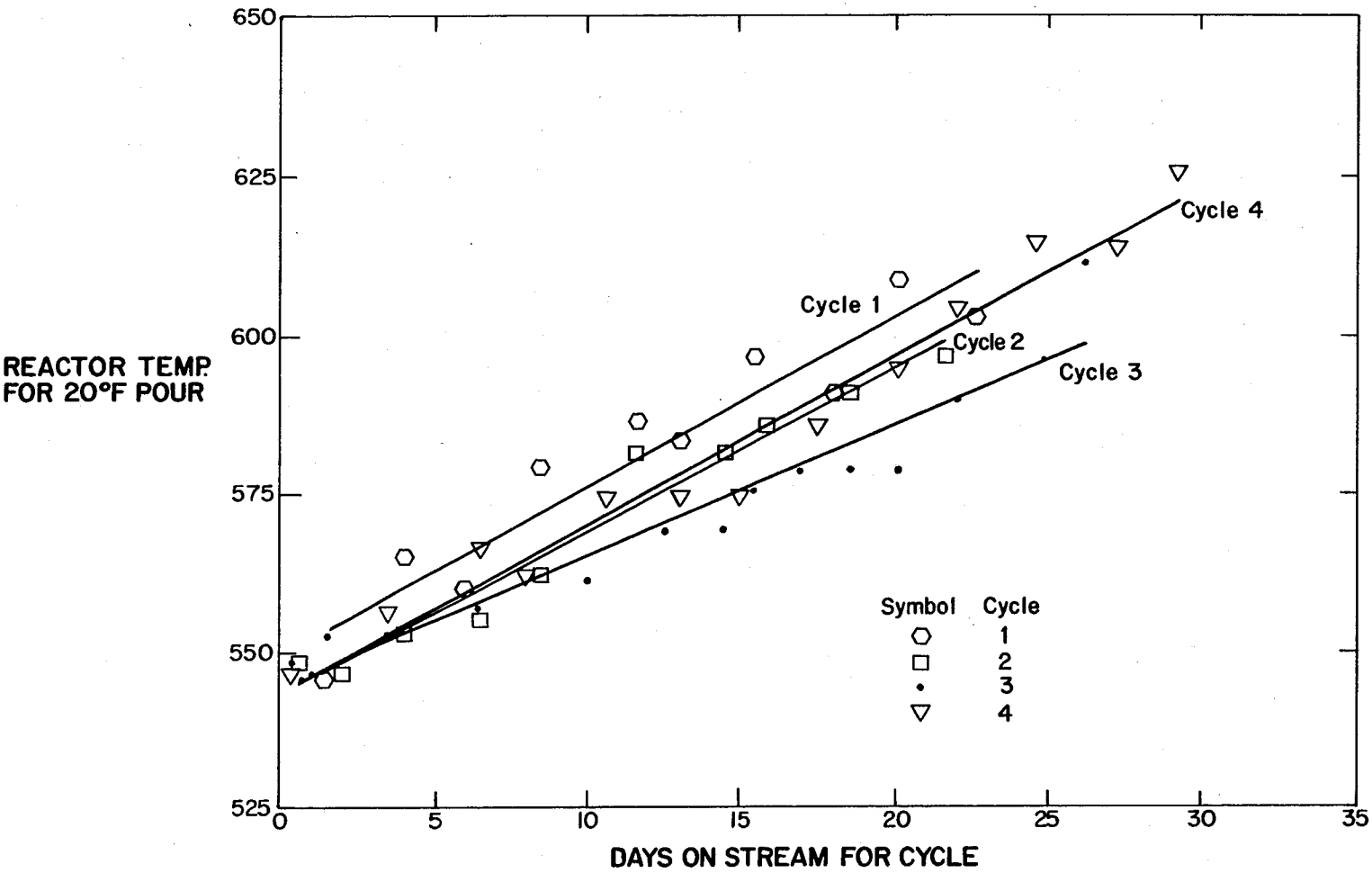
FIG. 3 is a plot illustrating the aging curves of regenerated catalysts with use of guard bed.

Over four processing cycles with air regenerations in between cycles, the observed catalyst aging rates were 2.8° F./day, 2.5° F./day, 2.2° F./day and 2.6° F./day for first, second, third and fourth cycle, respectively. Start-of-cycle temperature as well as aging rate (aging rate accurate ∓0.5° F./day) are constant from one cycle to another, see FIG. 3.

Previously, (Examples 1 and 2) in the absence of alumina guard bed progressive aging was observed as the number of cycles increased regardless of catalyst reactivation mode. So far the use of guard bed presented the only case where irreversible catalyst aging was eliminated or drastically reduced. The use of guard bed effected no changes in product yields or quality, and demonstrated the stability of ZSM-5 catalyst. Based on these results, in the absence of guard bed, feed contaminants, or the interaction of the contaminants with the dewaxing catalyst can affect catalyst performance by restricting or slowing down the diffusion of branched and cycloalkyl hydrocarbon into the zeolite.

Following the completion of the fourth cycle, the effectiveness of hydrogen rejuvenation in the presence of guard bed was studied. Compared to the fresh catalyst, hydrogen reactivation increased SOC from 550° to 560° F. Aging rate increased from 2.8° F./day for fresh catalyst to 4.3° F./day following hydrogen reactivation. Standard hydrogen activation may be effective in restoring catalyst acidity, but does not not remove all the hydrocarbon deposits. These remaining hydrocarbon deposits slow down the diffusion of branched and cycloalkyl hydrocarbons. Two successive air regenerations (cycle 6 and 7) were carried out following the hydrogen reactivation cycle (cycle 5).

Cycle No. 6 was a 42 day long cycle. During this cycle the catalyst exhibited an average rate of 2.9° F./day. Following the completion of the 42 day long cycle, the catalyst was air regenerated and bright stock was processed over this seventh cycle for seven days. During this short cycle the catalyst observed aging rate is 2.9° F.

The use of guard bed can effectively stabilize the cycle to cycle dewaxing performance of dewaxing catalysts.

What is claimed:

1. A process for decreasing the aging rate of a catalyst used in a cyclic catalystic dewaxing process for preparing a high quality lube base stock oil from a waxy chargestock having an initial boiling point of at least about 450° F., and which requires regeneration of dewaxing catalyst spent in catalystic dewaxing afer which regeneration the activity of the dewaxing catalyst as measured by alpha value is maintained at substantially that of the fresh dewaxing catalyst, which process comprises decreasing the increase in aging rate exhibited by the regenerated dewaxing catalyst when it is recycled to a dewaxing cycle, which process comprises in combination the steps of (a) contacting said chargestock, prior to said dewaxing, with a sorbent at temperatures greater than 350° F., a pressure of about 0 to 3000 psig at a LHSV of 0.1 to 100 wherein said contacting is effective to substantially eliminate said aging, and then, (b) after sorbent contact, contacting said chargestock, in the presence of hydrogen, with a dewaxing catalyst under dewaxing conditions effective to reduce the pour point of said chargestock, wherein said dewaxing catalyst comprises a crystalline alumino silicate zeolite having a Constraint Index within the range of one to twelve, whereby the dewaxing catalyst is spent nad contains coke;

(c) isolating said spent dewaxing catalyst from the sorbent and (d) regenerating said spent dewaxing catalyst in oxygen subsequent to said dewaxing; and maintaining said spent dewaxing catalyst isolated from the sorbent during said regenerating (e) recycling said oxygen regenerated dewaxing catalyst to step (b) whereby the aging rate of said oxygen regenerated dewaxing catalyst is substantially identical to the aging rate if dewaxing catalyst used in step (b).

2. The process as described in claim 1, wherein said sorbent is selected from the group consisting of alumina, clay, bauxite, crystalline zeolites, and microporous crystalline solids containing phosphates.

3. The process as described in claim 1 wherein said sorbent has a surface area of more than 50 m²/g and at least 10% of the pores are in the range of 30–1OO A.

4. The porcess of claim 1 wherein said sorbent is gamma alumina, eta-alumina or mixtures thereof.

5. The process of claim 1 wherein said zeolite is selected from the group consisting of ZSM-5, ZSM-11, ZSM-12, ZSM-23, ZSM-38 and ZSM-48.

6. The process of claim 1 wherein said isolating is undertaken by decoupling a reactor containing said sorbent from another reactor containing said dewaxing catalyst.

7. The process of claim 1, which further includes the step of replacing sorbent in step (a) after isolating an accordance with step (c).

8. The process of claim 1, wherein said dewaxing catalyst further comprises a metal selected from Groups I through VIII of the Periodic Table.

9. The process of claim 1, wherein the sorbent removes coponents of the feed which alter the diffusion properties of the fresh dewaxing catalyst.

10. A process for decreasing the aging rate of a dewaxing catalyst used in a multicycle dewaxing process for preparing a high quality lube base stock oil from a waxy chargestock having an initial boiling point of at least about 450° F., which process comprises, contacting said chargestock, with a sorbent and then contacting said chargestock, with a dewaxing catalyst wherein said sorbent removed components from the chargestock which alter the diffusion properties of the zeolite and increase the aging rate of the dewaxing catalyst after regeneration wherein the condition under which said chargestock is contacted with said sorbent include a temperature greater than 350° F., a pressure of about 0 to 3000 psig at a LHSV of 0.1 to 100; and wherein said dewaxing catalyst comprises a crystalline aluminosilicate zeolite having a Constraint Index within the range of 1 to 12 and wherein the temperature at which said chargestock is contacted with said dewaxing catalyst ranges from 400° F. to 1000° F. and the pressure, during said contact with said dewaxing catalyst, ranges from 0 to 3000 psig.

regenerating said dewaxing catalyst in a unit isolated from said sorbent and then passing addition chargestock, contacted with sorbent, over said regenerated dewaxing catalyst under conditions of temperature and pressure substantially identical to those in said contacting said chargestock with dewaxing cataylst prior to said regeneration.

11. The process of claim 10, wherein said sorbent is selected from the group consisting of alumina, clay, bauxite, crystalline zeolites, and microporous crystalline solids containing phosphates.

12. The process of claim 10, wherein said sorbent has a surface area of more than 50 $m^2/g$ and at least 10% of the pores are in the range of 30–100 A.

13. The process of claim 10, wherein said sorbent is gamma alumina, eta-alumina or mixtures thereof.

14. The process of claim 10, wherein said zeolite is selected from the group consisting of ZSM-5, ZSM-11, ZSM-12, ZSM-23, ZSM-38, and ZSM-48.

15. The process of claim 10 wherein said isolated is undertaken by decoupling a reactor containing said sorbent from another reactor containing said dewaxing catalyst.

16. The process of claim 10, which further includes the step of replacing said sorbent.

17. The process of claim 10, wherein the temperature at which chargestock contact with said sorbent is undertaken ranges from 400° to 850° F.

18. The process of claim 10, wherein said dewaxing is undertaken in the presence of hydrogen and the $H_2$/hydrocarbon mole ratio is 1 to 20.

19. The process of claim 10, wherein said dewaxing catalyst comprises a metal selected from Groups I through VIII of the Periodic Table.

20. The process of claim 10, wherein the sorbent removes components of the feed which alter the diffusion properties of the fresh dewaxing catalyst.

* * * * *